US005243839A

United States Patent [19]

DiGiuseppe et al.

[11] Patent Number: 5,243,839

[45] Date of Patent: Sep. 14, 1993

[54] SINKER CAM ASSEMBLY FOR A KNITTING MACHINE

[76] Inventors: Joseph DiGiuseppe, 200 Morgantown Rd.; Joseph E. DiGiuseppe, 334 S. Main St., both of Franklin, Ky. 42134

[21] Appl. No.: 964,300

[22] Filed: Oct. 21, 1992

[51] Int. Cl.[5] ..... D04B 9/00; D04B 15/34

[52] U.S. Cl. ..... 66/108 R; 66/57; 66/217

[58] Field of Search ..... 66/57, 104, 107, 108 R, 66/108 A, 109, 217, 78

[56] References Cited

U.S. PATENT DOCUMENTS

| | | | |
|---|---|---|---|
| 3,293,887 | 12/1966 | Crawford | 66/108 R |
| 3,331,219 | 7/1967 | Brook | 66/108 |
| 3,413,823 | 12/1968 | Beucus | 66/9 |
| 4,040,276 | 8/1977 | Koegel | 66/107 |

FOREIGN PATENT DOCUMENTS

| | | | |
|---|---|---|---|
| 287286 | 8/1981 | Fed. Rep. of Germany | 66/57 |

*Primary Examiner*—Clifford D. Crowder
*Assistant Examiner*—John J. Calvert
*Attorney, Agent, or Firm*—Maurice L. Miller, Jr.

[57] ABSTRACT

An improved sinker cam assembly for a circular knitting machine is disclosed which contains a series of cam segments attached to a stationary circular cam ring to form an endless undulating cam race. The assembly also includes a rotating sinker ring to which a plurality of sinkers are slidably attached for reciprocal movement as the sinker ring rotates relative to the cam ring. Each sinker conventionally contains a radially inwardly located, axially extending cam follower arm and a spaced apart, radially outwardly located, axially extending cam follower arm. The arms confine the cam surfaces of the cam race therebetween so that the cam surfaces control the reciprocal movements of the sinkers as the sinker ring rotates. The cam elements contain gaps between successive pairs thereof, which have gap openings on the two cam surfaces. The cam elements are constructed such that the outer and inner gap openings of each gap fall on distinctly separate radial lines extending from the axial center of the cam ring such that the outer arm of any one of the sinkers completely crosses an outer gap opening before the inner arm of that sinker encounters and crosses the inner gap opening of the corresponding gap. Banging and jolting of the sinkers as they each cross from one cam segment to the next is thus substantially eliminated.

6 Claims, 2 Drawing Sheets

SINKER CAM ASSEMBLY FOR A KNITTING MACHINE

BACKGROUND OF THE INVENTION

This invention relates to a circular cam ring assembly for use in controlling the reciprocal movements of yarn engaging sinker elements in a circular knitting machine. This invention also relates to the individual cam segments which are affixed to the cam ring so as to form a generally circular race having repetitive, wave-like variations which cause the sinkers to reciprocate as they travel around the race.

Broadly speaking, circular knitting machines for knitting jersey, terry cloth materials and the like have long been known and used in the prior art. Such machines typically include a sinker cam assembly having a stationary circular cam ring and a rotatable sinker ring disposed coaxially and in registry with the cam ring. The sinker ring contains a plurality of circumferentially spaced apart, radially extending slots which open onto a broad surface thereof so as to face the cam ring. A like plurality of yarn engaging sinkers are slidably disposed in the slots for repetitive, radially inward and outward movement to engage a thread of yarn, carry the yarn into engagement with a needle, and thereafter retract so that the yarn engaged needle can complete a stitch.

A series of individual cam segments are attached to the cam ring so as to form a pair of radially spaced apart, inwardly and outwardly facing cam surfaces forming a generally circular closed path or race around the cam ring which contains repetitive, wavelike variations. The sinkers each contain a pair of spaced apart axially extending arms which ride along these cam surfaces as the sinker ring rotates. The wavelike variations or undulations in the cam surfaces thus cause the sinkers to reciprocate in radial directions in their slots as the sinker ring rotates.

A difficulty encountered in using these prior art cam ring assemblies is caused by the gaps which exist between adjoining pairs of cam segments. As a given radially extending sinker crosses the gap that exists between adjoining cam segments, centrifugal force caused by rotation of the sinker ring urges the sinker to move outwardly in its slot so that the radially inwardly located sinker arm moves into the inwardly opening end of the gap. As the sinker ring continues to rotate such that the sinker crosses the gap, the radially inwardly located arm tends to strike a leading edge portion of the inwardly facing cam surface of the next succeeding cam segment with a glancing blow. During each revolution of the sinker ring, a given sinker will thus strike the leading edge portion of that cam surface of the various cam segments as many times as there are gaps in the cam ring.

Accordingly, the individual sinkers are subjected to many glancing blows during each revolution of the sinker ring, all of which produces wear and damage to the sinkers, which necessitates frequent down time for replacement of the sinkers. Moreover, these glancing blows of the many sinkers in a given sinker ring against each of the cam segments causes wear and damage to the relatively more expensive cam segments which, likewise, necessitates down time and replacement of the cam segments, which is a substantially greater expense than that of replacing the sinkers.

In some types of circular knitting machines, this problem has been dealt with by using relatively long arcuate cam segments so that relatively few segments, and, therefore, relatively few gaps between adjoining segments, exist around a cam ring. Accordingly, the sinkers encounter fewer gaps with each revolution of the sinker ring about the cam ring and thus encounter fewer jolts and glancing blows per revolution. Also, the straight ends of these prior art cam segments are sometimes tapered so as to be at an oblique angle relative to a radius of the sinker and/or cam ring which is drawn through either end of the gap between adjoining segments, so that the sinker will not tend to drop into the gap and thereby encounter a tearing, bending or otherwise deforming jolt when crossing the same. See, for example, U.S. Pat. No. 4,040,276 issued to R. A. Koegel on Aug. 9, 1977.

But some types of knitting machines are not adapted for using relatively long arcuate cam segments because of the numerous specific knitting operations to be performed during each revolution of the sinker ring, so that there is still a great need to use a cam ring assembly having a large number of relatively small cam segments. Since these small prior art cam segments are typically steel castings, there is a relatively wide range of dimensional variations between the largest and smallest ones in a given set such that they can not be closely fit end-to-end, whereby they contain relatively wide gaps between adjacent pairs when affixed to a cam ring.

By means of our invention as herein disclosed, these and other difficulties encountered using sinker cam assemblies in knitting machines of the prior art are substantially reduced, if not altogether eliminated.

SUMMARY OF THE INVENTION

It is an object of our invention to provide a novel sinker cam assembly for a circular knitting machine.

It is a further object of our invention to provide a novel sinker cam assembly for a circular knitting machine wherein the sinkers which travel along a cam ring of the assembly cross each of the gaps between successive ones of the cam segments thereof smoothly and without glancing off of the leading edge of the cam surface of the next succeeding cam segment located beyond the gap.

Briefly, in accordance with our invention we provide an improvement to a circular knitting machine of the type which conventionally includes a rotatable sinker ring containing a plurality of circumferentially spaced apart, radially extending slots opening on to a broad surface thereof. The machine also conventionally includes a stationary cam ring disposed coaxially and in registry with the sinker ring, and a plurality of yarn engagable sinkers. Each of the sinkers has a base which is slidably disposed in a different one of the slots, a first axially projecting arm attached to a radially inwardly located end of the base, and a second axially projecting arm attached to a radially outwardly located end of the base. The improvement which we provide comprises a series of cam elements adjoining one another which are attached to and around the cam ring to form a first endless, radially inwardly facing cam surface and a second endless, radially outwardly facing cam surface spaced from the first cam surface. The first and second arms of the sinkers extend at least partially across the first and second cam surfaces, respectively, for radial inward and outward reciprocating movement of the sinkers in the slots as the sinker ring rotates. Adjoining surfaces of adjacent pairs of the cam elements form gaps, each of which gaps have a first opening extending across the first cam surface and a second opening extending across the second cam surface such that a line drawn through the first and second openings of any one of the gaps forms an oblique angle with respect to a radial line drawn from an axis of the cam sinker ring through either one of the gap openings. The oblique angle is at least sufficient in size such that the second arm of each one of the sinkers crosses each of the second gap openings before the corresponding first arm of each of the sinkers crosses a corresponding one of the first gap openings. Accordingly, one arm of any one of the sinkers bears against its corresponding cam surface as the other arm crosses a gap opening in its corresponding cam surface.

These and other objects, features and advantages of the present invention will become apparent to those skilled in the art from the following detailed description and attached drawings upon which, by way of example, only a preferred embodiment of our invention is explained and illustrated.

DESCRIPTION OF THE PREFERRED EMBODIMENT

Figure 1:
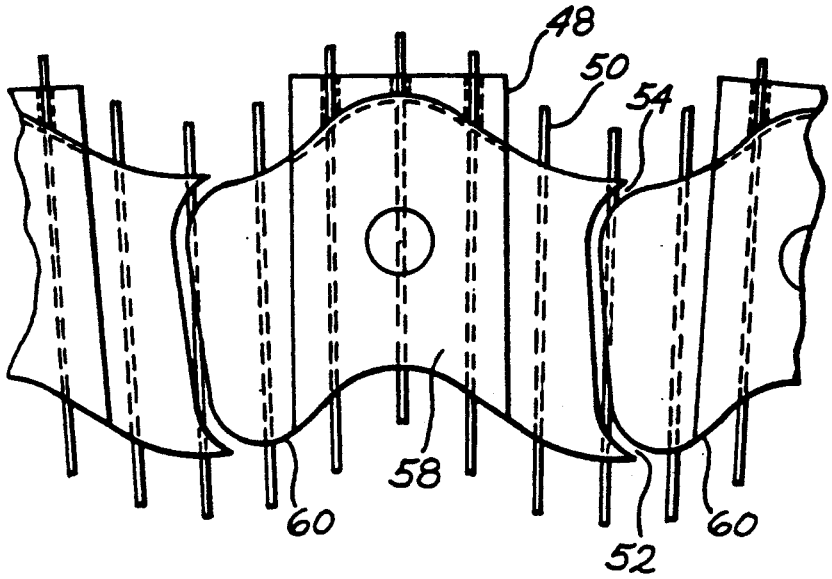
FIG. 1 PRIOR ART
FIG. 1 shows a plan view of an arcuate portion of a circular sinker cam assembly of the prior art as used in a conventional circular knitting machine.

Referring now to the drawing figures and, specifically, to FIGS. 2-5 there is shown, in a preferred embodiment of our invention, a novel sinker cam assembly, generally designated 10, for use in a circular knitting machine. The knitting machine may be of well known type such, as for example, a Vanguard 1SJ4 Knitting Machine, as manufactured by Vanguard Supreme, Inc. of Monroe, N.C., and which is adapted for knitting jersey and terry cloth materials, whereby it need not be shown.

Figure 2:
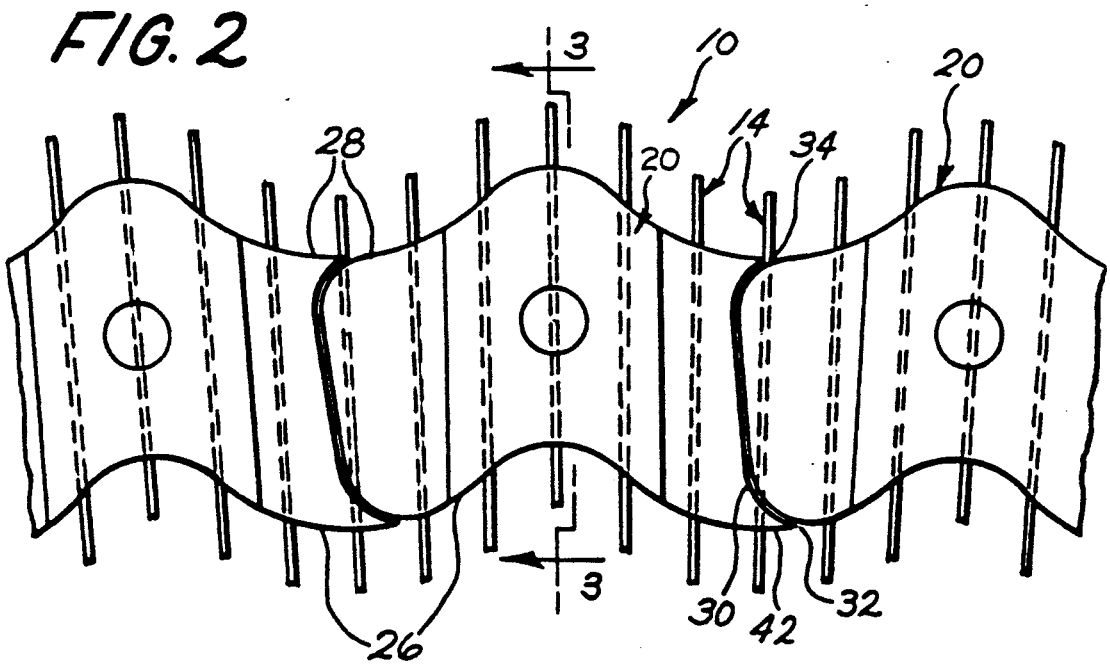
FIG. 2 shows a plan view of an arcuate portion of a novel circular sinker cam assembly for use in an otherwise conventional circular knitting machine, thus illustrating a preferred embodiment of our invention.

The assembly 10 includes an annularly shaped rotatable sinker ring 12 of conventional type which contains a plurality of circumferentially spaced apart thread engagable sinkers 14 which are slidably disposed in radially extending slots 15 which open onto an upper broad surface 16 (as viewed in FIGS. 3-4) of the ring 12. The assembly 10 also includes an annularly shaped stationary cam ring 18 which contains a series of slots 19 spaced therearound in which a series of cam segments 20 are removably secured in any suitable manner. The various cam segments 20 are constructed so as to fit relatively closely together to form a circle of such segments about the cam ring 18, as represented by the circular arc shaped portion as shown in FIG. 2. Each of the cam segments 20 contain a curved concave side edge portion 22 and a conformingly curved convex opposite side edge portion 24 (See FIGS. 2 and 5). Thus, opposing side edge portions 22, 24 of successive ones of the cam segments 20 fit closely together around the cam ring 18 as best seen in FIG. 2. As a result, a pair of endless undulating cam surfaces 26 and 28 are formed around the ring 18, the surface 26 of which faces radially inwardly and the surface 28 of which faces radially outwardly. There is, however, a slight gap 30 which exists between the adjoining concave and convex side edge portions 22 and 24 of successively disposed pairs of cam segments 20 which tend to interrupt the otherwise smooth continuous undulating surfaces 26 and 28 as at gap openings 32 and 34, respectively.

Figure 3:
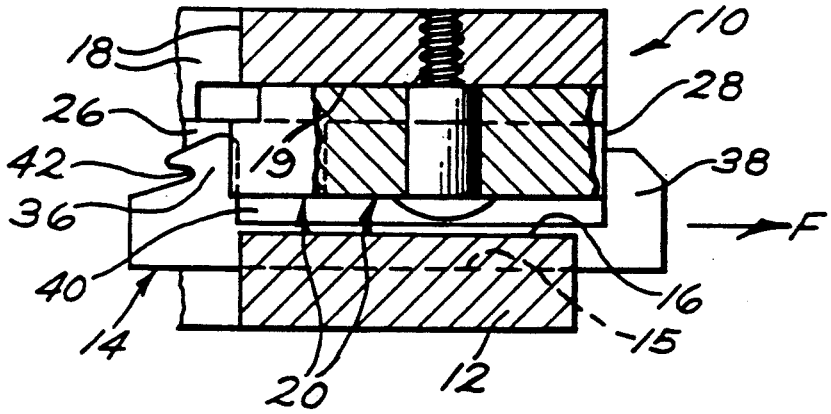
FIG. 3 shows a cross-sectional edge view of a single sinker element and cam segment of the assembly of FIG. 2 as viewed along cross-section lines 3—3 of the latter mentioned figure with certain other parts replaced that are missing in FIG. 2.
Figure 4:
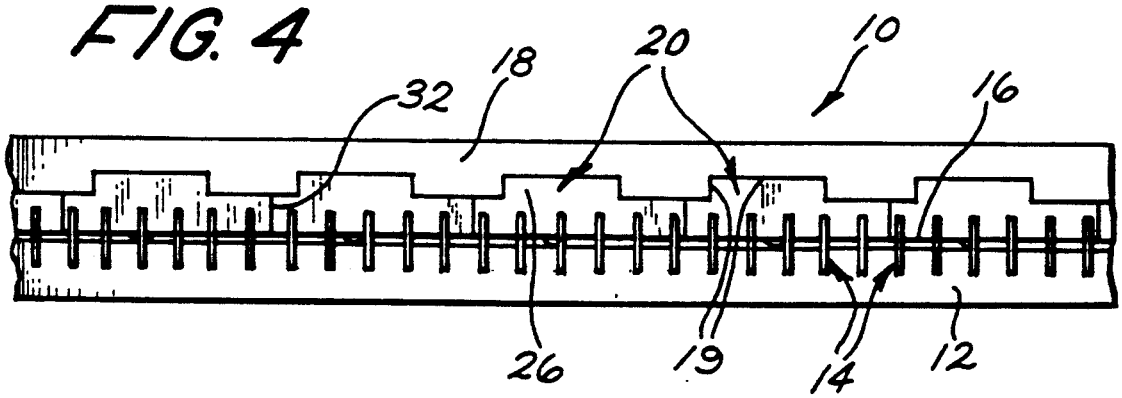
FIG. 4 shows a radially inwardly facing edge view of an arcuate portion of the assembly of FIGS. 2-3 of the latter mentioned figure as viewed outwardly along a radius of said assembly.
Figure 5:
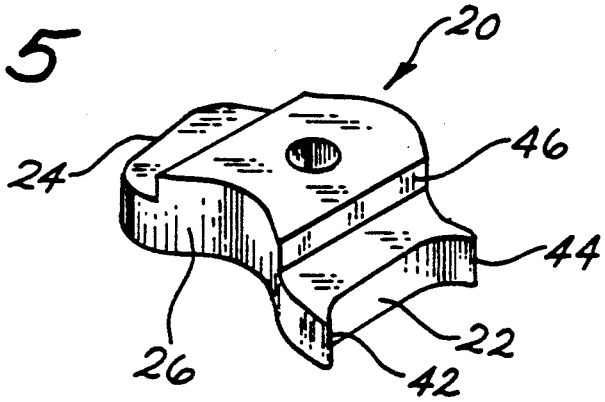
FIG. 5 shows a perspective view of one of the cam segments of FIGS. 2 and 4.

As shown best in FIG. 3, each sinker element 14 contains an elongated, radially extending body portion which is slidably disposed in one of the slots 15 of the sinker ring 12. The sinker elements 14 each contain a radially inwardly located, axially extending cam follower arm 36, and a radially outwardly located, axially extending cam follower arm 38. The arms 36 and 38 are radially spaced apart from one another and extend axially across an air gap 40 and at least a portion of the cam surfaces 26 and 28, respectively. The arms 36 and 38 thus closely confine the surfaces 26 and 28 therebetween so that each of the sinkers 14 reciprocates radially inwardly and outwardly through one complete cycle as they travel along the surfaces 26 and 28 of each of the cam segments 20 as the sinker ring 18 rotates. Slightly more than two complete cycles of reciprocation of certain of the sinkers 14 is illustrated in FIG. 2. Note also the presence of a notch 42 (FIG. 3) on the arm 36 which is adapted to engage a thread of yarn during its radially inward movement and present the same to a needle for knitting a stitch.

As mentioned in the Background portion hereof and as shown in FIG. 1, such movements of prior art sinkers 50 across the end openings 52 and 54 of the rather sizable gaps 56 that exist between successive pairs of prior art cam elements 58 often result in the inwardly located cam follower sinker arms striking the leading edge portions of the inwardly facing cam surface 60 of the next cam segment in their path with a damaging glancing blow. The cam segments of our invention, such as illustrated at 20 in FIGS. 2-5 substantially eliminate this problem because we have substantially lengthened a radially inwardly located corner portion 42 and substantially shortened a radially outwardly located corner portion 44 of the concave side edge 22 relative to the corresponding features of prior art cam segments 58 of FIG. 1. This has the affect of tilting the gap 30 relative to the alignment of a sinker element 14 passing thereover. Thus, as shown in FIGS. 2-3, when the outwardly located follower arm 38 of a sinker 14 passes over an outer gap opening 34, the inwardly located follower arm 36 of the same sinker element 14 is still riding upon the smooth surface 26 and has not yet reached the corresponding inner gap opening 32. At this position, a centrifugal force F (FIG. 3), caused by rotation of the sinker ring 12, which always tends to urge the sinker 14 radially outwardly in its slot 15, maintains the arm 36 in tight but slidable engagement with the surface 26. Thus, at this position, the surface 26 totally controls the radial movement and radial position of the sinker 14, and the outwardly located arm 38 can cross the outer gap opening 34 freely without, in any way affecting radial movement of the sinker 14. And because the inwardly located arm 36 bears against the surface 26 at this point, the outwardly located arm 38 will not tend to float or sink inwardly into the gap opening 34 as it crosses the same.

Now as the outwardly located arm 38 crosses the gap opening 34, it thereafter reengages the surface 28 on the other side of the opening. Since this surface is rising radially outwardly with further movement of the sinker 14 (upwardly with further movement to the right as viewed in FIG. 2), the outwardly facing cam surfaee 28 now bears outwardly against the arm 38 and now totally controls the radial movement of the sinker 14 as the inwardly located arm starts and completes its passage across the inwardly opening gap 32.

Thus, the arms 36 and 38 of a given sinker 14 can not cross corresponding inwardly and outwardly facing gap openings 32 and 34 of the same gap 30 at the same time, as often occurs using cam segments of the prior art such as shown in FIG. 1. And because the sinkers 14 are never free of control by one or the other of the surfaces 26 and 28 of the cam segments 20, they are never free to float out of control across one of the gaps 30 so as to bang or slam into a leading edge portion of an inwardly facing surface 26 of a cam segment 20 lying just beyond the subject gap 30. The result is that the sinkers 14 move smoothly along the inner and outer surfaces 26 and 28 as the sinker ring 12 rotates, as though there were no gaps 30 between adjoining pairs of the cam segments 20. Damage to both the sinkers 14 and the cam segments 20 is thus substantially reduced compared with that encountered using the sinker and cam elements of the prior art as shown in FIG. 1.

We have also found that the raised portion 46 of the cam segment 20 (See FIG. 5) which fits into a corresponding slot 19 of the sinker ring 18 (FIGS. 3–4), can be formed so that both its radially inwardly and outwardly facing edges conform to the undulations of the cam surfaces 26 and 28. There is no need for a rectangular tab portion to project radially outwardly beyond the radially outwardly facing cam surface 28 as in the case with the raised tab portion 48 of the prior art cam segment 58 of FIG. 1. Thus, the size, weight and amount of material used in each of the cam segments 20 is also substantially reduced relative to that of the prior art cam segment 48.

Although the present invention has been described with respect to specific details of a certain preferred embodiment thereof, it is not intended that such details limit the scope of the patent other than as specifically set forth in the following claims.

We claim:

1. An improved sinker cam assembly for use in a circular knitting machine of the type which conventionally includes a rotatable sinker ring containing a plurality of circumferentially spaced apart, radially extending slots opening onto one broad surface thereof, a stationary cam ring disposed coaxially and in registry with said sinker ring, and a plurality of yarn engagable sinkers, each of sinkers having a base which is slidably disposed in a different one of said slots, a first axially projecting cam follower arm attached to a radially inwardly located end of said base, and a second axially projecting cam follower arm attached to a radially outwardly located end of said base, the improvement of which comprises, a series of cam segments adjoining one another and attached to and around said cam ring to form a first endless, radially inwardly facing cam surface and a second endless, radially outwardly facing cam surface spaced from said first cam surface, said first and second arms of said sinkers extending at least partially across said first and second cam surfaces, respectively, for radially inward and outward reciprocating movement of said sinkers in said slots as said sinker ring rotates, adjoining surfaces of adjacent pairs of said cam elements forming gaps, each of said gaps having a first opening across said first cam surface and a second opening across said second cam surface such that a line drawn through said first and second openings of any one of said gaps forms an oblique angle with respect to a radial line drawn from an axis of said cam and sinker rings through either one of said openings, said oblique angle being at least sufficient in size such that said second arm of each one of said sinkers crosses each of said second gap openings before the corresponding first arm of each of said sinkers crosses a corresponding one of said first gap openings, whereby one arm of any one of said sinkers bears against the corresponding cam surface of said one arm as the other arm of a corresponding one of said sinkers crosses a gap opening in the corresponding cam surface of said other arm.

2. The improvement of claim 1 wherein each of said cam elements includes a raised tab located on a central portion thereof which extends radially between and terminates in conformity with the undulations of the corresponding radially inwardly and radially outwardly facing cam surfaces of said elements.

3. The improvement of claim 1 wherein the width of each of said first and second gap openings is less than the thickness of each of said sinkers.

4. In an improved sinker cam assembly for use in a circular knitting machine of the type which conventionally comprises a rotatable sinker ring, a stationary cam ring disposed coaxially and in registry with said sinker ring, a plurality of yarn engagable sinkers slidably disposed radially on and around said sinker ring, each of said sinkers having a pair of spaced apart, axially extending cam follower arms, the improvement of which comprises, a series of cam segments adjoining one another and attached to said cam ring to form a first endless, radially inwardly facing cam surface and a second, radially outwardly facing cam surface, the arm pairs of each of said sinkers extending at least partially across said first and second cam surfaces in close fitting slidable relationship as said sinker ring rotates, successive pairs of said cam segments each having a gap therebetween which has a first opening on said inwardly facing cam surface and a second opening on said outwardly facing cam surface, said first and second openings of each of said gaps being located on a distinctly different radius of said cam ring such that an outwardly located arm of each one of said sinkers crosses each one of said second gap openings while said inwardly located arm of a corresponding one of said sinkers bears radially outwardly against a portion of said inwardly facing cam surface prior to crossing a first opening of a corresponding one of said gaps.

5. The improvement of claim 4 wherein the width of each of said first and second gap openings is less than the thickness of each of said sinkers.

6. The improvement of claim 4 wherein each of said cam elements includes a raised tab located on a central portion thereof which extends radially between and terminates in conformity with the undulations of the corresponding radially inwardly and radially outwardly facing cam surfaces of said elements.

* * * * *